US006024836A

United States Patent [19]

Sollinger et al.

[11] Patent Number: 6,024,836

[45] Date of Patent: Feb. 15, 2000

[54] PROCESS AND DEVICE FOR PRODUCTION OF A PULP WEB

[75] Inventors: Hans-Peter Sollinger, Heidenheim; Markus Oechsle, Bartholomae, both of Germany

[73] Assignee: Voith Sulzer Papiermaschinen GmbH, Heidenheim, Germany

[21] Appl. No.: 08/772,092

[22] Filed: Dec. 20, 1996

[30] Foreign Application Priority Data

Dec. 22, 1995 [DE] Germany ..... 195 48 294

[51] Int. Cl.[7] ..... D21F 7/02

[52] U.S. Cl. ..... 162/206; 162/207; 162/201; 162/197; 34/121; 34/117

[58] Field of Search ..... 162/206, 207, 162/205, 201, 202, 197; 34/117, 116, 118, 121

[56] References Cited

U.S. PATENT DOCUMENTS

| | | | |
|---|---|---|---|
| 2,091,805 | 8/1937 | Chuse | 162/207 |
| 3,257,734 | 6/1966 | Boadway et al. | 162/207 X |
| 3,523,865 | 8/1970 | Ihrman | 162/207 X |
| 4,359,828 | 11/1982 | Thomas | 34/114 |
| 5,311,672 | 5/1994 | Kotitschke et al. | 34/117 |
| 5,542,193 | 8/1996 | Sims et al. | 34/117 |
| 5,638,611 | 6/1997 | Oechsle | 34/447 |

FOREIGN PATENT DOCUMENTS

| | | |
|---|---|---|
| 1449683 | 4/1973 | Germany . |
| 4218595 | 12/1993 | Germany . |

*Primary Examiner*—Jose Fortuna
*Attorney, Agent, or Firm*—Greenblum & Bernstein, P.L.C.

[57] ABSTRACT

A process and device for producing a pulp web utilizes several independently driven aggregates (i.e., discrete groups) to attain a median web dry content of, e.g., 60%. The number of driven aggregates may depend upon an initial wet strength of the wet pulp web. The relationship is such that when the initial wet strength is relatively high, the number of drier groups is small and when the initial wet strength is relatively low, the number of drier groups is large. However, each drier group includes only a few drier cylinders. The first drier group may include either one or two cylinders, and each subsequent drier group may include at least one drier cylinder more than the adjacent upstream drier group.

3 Claims, 1 Drawing Sheet

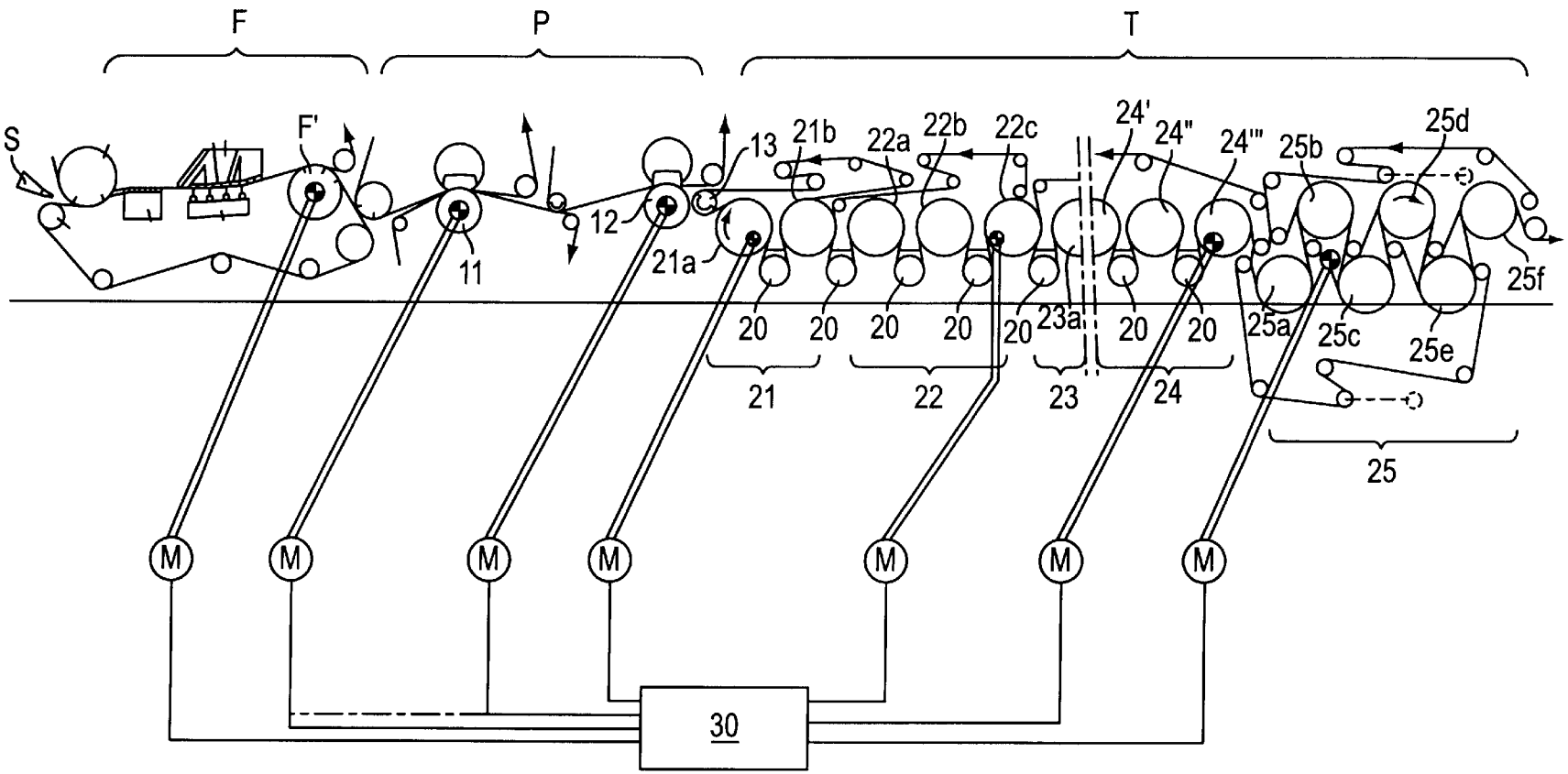
T
P
F
S
F'
11
12
13
21a
21b
22a
22b
22c
23a
24'
24"
24'''
25a
25b
25c
25d
25e
25f
20
21
22
23
24
25
30
M

PROCESS AND DEVICE FOR PRODUCTION OF A PULP WEB

CROSS-REFERENCE OF RELATED APPLICATIONS

The present invention claims the priority under 35 U.S.C. § 119 of German Patent Application No. 195 48 294.8 filed on Dec. 22, 1995, the disclosure of which is expressly incorporated by reference herein in its entirety.

BACKGROUND OF THE INVENTION

1. Field of the Invention

The present invention is directed to a process for producing a pulp web, e.g., a paper web, in a paper production machine. The present invention may also be directed to a device for performing the pulp web production process in which a number of individually driven aggregates utilized to attain a median web dry content is dependent upon an initial wet strength of the moist pulp web.

2. Discussion of the Background Information

FIG. 3 of DE 42 18 595 A1 shows an apparatus and method which is generally related to the present invention. A wet paper web is guided through at least one press slit of a press section to extract water and then to a drier section. The drier section includes, in a first part, several felt covered drier groups around which the web is sequentially guided. It is shown in this FIG. 3, without further explanation, that the number of cylinders increases from drier group to drier group.

The above-noted document also shows that the drives of the sequential aggregates (i.e., the last press and each subsequent drier group) are set at slight speed differences to stretch the still moist web in a running direction of the web between each adjacent aggregate. Thus, the process and device of the prior art are able to attain a stable run of the web through the paper production machine.

However, the above-noted device cannot efficiently operate at the increasingly more rapid operating speeds of modern paper production machines. Further, the running efficiency of the prior art device is reduced by an unacceptable number of paper web breaks.

SUMMARY OF THE INVENTION

Accordingly, the present invention is directed to a process and device that overcomes the above-noted drawbacks of the prior art. That is, the present invention, may operate at increasingly more rapid operating speeds while increasing running efficiency through the reduction of paper web breaks. Thus, the present invention may satisfy the paper users increasing demand for quality finished paper.

The present invention may be directed to the optimal treatment of a paper web guided through a first drier group while the paper web is still moist (wet). To optimize the paper web treatment, the initial wet strength (INF) of the still moist web should be considered.

The INF may be a value representing the strength of the still wet paper web, and may depend upon, e.g., the ash content (i.e., filler share) of the pulp. As the ash content increases, the wet strength of the paper web decreases, which renders more difficult the handling of the still wet paper web within the paper production machine.

In accordance with the present invention, the lower the INF of the wet paper web, the more small drier groups, i.e., more discrete drier groups in which each drier group has relatively few drier cylinders, should be positioned at an entry to the drier section. In addition, the present invention may consider the dry content of the paper web at the entry to the drier section such. For example, with a low entry dry content the system may utilize both the smallest sized drier groups at the start of the drier group and the greatest number of drier groups.

In extreme cases, e.g., when the wet paper web exhibits a low INF and a low entry dry content, the present invention may utilize only two to three drier cylinders in each of the first three drier groups. Further, in accordance with the present invention, the first drier group may include as few as a single drier cylinder.

In accordance with the present invention, the number of cylinders arranged in each drier group may increase by, e.g., one drier cylinder in each subsequent drier group.

In the present invention, the devices for driving the last press before the drier section and for driving the first drier groups may be set so that a slight speed difference occurs. This slight speed difference ensures that the still wet web may be slightly stretched in the running direction at each point of separation, i.e., moving from one aggregate to the next. According to the invention, the stretching occurs more often than in the prior art and in smaller increments along the length of the web.

Because of the smaller increments, the present invention may guide the still moist web essentially without an open web draw across each of the points of separation. Thus, in addition to guiding the web across the points of separation within the drier section, the present invention, guides the web across the point of separation between, e.g., the last press before the drier section and the first drier group and between the point of separation between the presses within the press section, if applicable. In the present manner, the wet web may be guided more gently through the paper machine, thereby considerably reducing the danger of web breaks. Further, the speed of each aggregate may be independently regulated (controlled) to maintain tension of the pulp web within the points of separation. Accordingly, at a beginning of the drier section, the downstream aggregate may be regulated at a speed greater than an adjacent upstream aggregate due to stretching of the wet web. Conversely, at an end of the drier section, the downstream aggregate may be driven at a speed less than an adjacent upstream aggregate due to shrinkage of the web.

Accordingly, the present invention may be directed to a process for the production of a pulp web in a paper production machine. The process may include forming the pulp web from a pulp suspension, guiding a moist pulp web through a plurality of individual aggregates in a running direction, the individual aggregates including at least one press section and a plurality of drier groups, independently driving each aggregate, maintaining tension on the moist pulp web at each transition between adjacent aggregates, and determining a specified number of aggregates based upon an initial wet strength of the moist pulp web.

In accordance with a further feature of the present invention, the process may include guiding the moist pulp web from an upsteam aggregates to an adjacent downstream aggregate substantially without an open draw.

In accordance with still another feature of the present invention, the process may include guiding the moist pulp web into an initial portion of a drier section, the initial portion of the drier section including a plurality of drier cylinders, and contacting the plurality of drier cylinders in the initial portion of the drier section with a lower side of said moist web.

The present invention may also be directed to a device for performing a process for the production of a pulp web in a paper production machine. The device may include a plurality of individually drivable aggregates including at least one wet press and a specified plurality of top-felted driers, the specified plurality of top-felted driers determined in accordance with an initial wet strength of a moist pulp web being produced, the plurality of individually drivable aggregates maintaining tension on the moist pulp web between each adjacent aggregate, the specified plurality of top-felted driers comprising a plurality of drier groups including a first drier group adjacent the at least one wet press, the first drier group having four or fewer drier cylinders.

In accordance with still another feature of the present invention, the first drier group may include not more than two drier cylinders.

In accordance with yet another feature of the present invention, the plurality of drier groups may further include a second drier group positioned adjacent the first drier group, the second drier group including one more drier cylinder than the first drier group.

In accordance with another feature of the present invention, the at least one wet press may include at least one shoe press.

In accordance with a further feature of the present invention, the at least one wet press may include a first and second press section, the first and second press sections being synchronously driven.

The present invention may also be directed to an apparatus for producing a pulp web moving in a running direction. The apparatus may include a specified number of drier groups, the specified number of drier groups determined in accordance with an initial wet strength of a wet pulp web.

In accordance with another feature of the present invention, each of the specified number of drier groups including at least one drier cylinder, and each of the specified number of drier groups including one more drier cylinder than an adjacent upstream drier group.

In accordance with still another feature of the present invention, the apparatus may further include at least one of a press roll and a press cylinder and a speed regulator, the speed regulator independently driving each of the specified number of drier groups and the at least one of the press roll and press cylinder.

In accordance with yet another feature of the present invention, each of the specified number of drier groups may be independently driven at a speed related to a speed at which an adjacent upstream drier group is driven to maintain tension on the web, and a first drier group of said specified number of drier groups being driven at a speed greater than the at least one of the press roll and press cylinder. Further, a last drier group may be driven at a speed less than an adjacent upsteam drier group.

In accordance with a further feature of the present invention, the at least one of the press roll and press cylinder may include a first and second press pair, the second press pair, being located downstream of the first press pair, being driven at a speed greater than the first press pair.

In accordance with still another feature of the present invention, the at least one of the press roll and press cylinder may include a first and second press pair, the second press pair, being located downstream of the first press pair, being driven synchronously with the first press pair.

In accordance with another feature of the present invention, the apparatus may further include at least one additional drier group, the additional drier group including between five and eight drier cylinders.

In accordance with still another feature of the present invention, each of the specified number of drier groups may include a single felt drier group having at least one drier cylinder in which only one side of the pulp web contacts the drier cylinder, and the at least one additional drier group may include a double felt drier group.

In accordance with a further feature of the present invention, the at least one additional drier group may be independently driven at a speed greater than an adjacent upsteam one of the specified number of drier groups.

In accordance with another further feature of the present invention, the at least one additional drier group may be independently driven at a speed less than an adjacent upstream one of the specified number of drier groups.

According to the present invention, the number of aggregates utilized in the web production machine may be determined by the initial wet web strength (INF). The number of aggregates is greater when a low initial wet web strength is utilized. Conversely, the number of aggregates is lower when a high initial wet web strength is utilized.

The present invention may achieve its gentle guidance of the wet web by facilitating at least one of the press sites of the press section, and preferably each of the press sites of the press section, as a long-slit (extended nip) press. The extended nip press may also include press shoe actuation.

BRIEF DESCRIPTION OF THE DRAWINGS

The present invention is further described in the detailed description which follows, in reference to the noted drawing by way of non-limiting examples of preferred embodiments of the present invention, and wherein:

The FIGURE illustrates a schematic side view of a paper production machine for performing the process of the present invention.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The main sections of a paper machine, as schematically shown in the FIGURE, may include a pulp arrival section S, a twin wire shaper F, a press section P, and a drier section T. It is noted that while there are other important sections of the paper machine, e.g., a calender, a coater, and a rewind apparatus, these sections have been omitted for the sake of clarity.

The paper production machine of the present invention may be divided into a plurality of aggregates (groups), i.e., discrete sections of the machine performing a predetermined operation. For example, the aggregates for the present invention may include at least one extended nip press, a plurality of short drier groups located within an initial portion of drier section T, and a plurality of long drier groups located within a remaining portion of drier section T. The short drier groups are termed "short" with respect to the remaining drier groups within drier section T. In accordance with the FIGURE, the plurality of aggregates may include extended nip press 11, extended nip press 12, short drier group 21, short drier group 22, and short drier group 23.

The extended nip presses 11 and 12 may each include a press shoes for providing downward pressure on the pulp web being guided through each respective extended nip and may each include at least one moving felt that transfers and guides the pulp web through the extended nip. The extended nip presses may include, e.g., a pair of press rolls or press cylinders. The extended nip press may be utilized to extract moisture from the pulp web prior to its entry into drier section T. To transfer the pulp web from press section P to drier section T without an open draw, a suction guide roll 13 may be positioned at a separation point between the last extended nip press 12 and the first drier group 21.

First drier group 21 may include at least one drier cylinder, and, as shown in the FIGURE, may include drier cylinder 21*a* and drier cylinder 21*b*. Each subsequent drier group in the initial portion of drier section T, e.g., drier groups 22 and 23, may include, e.g., one more drier cylinder than the previous drier group. As shown in the FIGURE, second drier group 22 may include three drier cylinders, e.g., drier cylinder 22*a*, drier cylinder 22*b*, and drier cylinder 22*c*; third drier group 23, only partially shown, may include four drier cylinders, e.g., drier cylinder 23*a* and three additional drier cylinders that are not shown.

The remaining drier groups, e.g., drier group 24, only partially shown, and drier group 25, may contain a relatively large number of drier cylinders with respect to short drier groups 21, 22, and 23. That is, drier groups 24 and 25 may include, e.g., five to eight drier cylinders. In the FIGURE, the last three drier cylinders 24', 24", and 24'" of drier group 24 are shown; drier group 25 may include drier cylinder 25*a*, drier cylinder 25*b*, drier cylinder 25*c*, drier cylinder 25*d*, drier cylinder 25*e*, and drier cylinder 25*f*.

According to the present invention, after passing through the initial portion of drier section T, the pulp web may attain a predetermined median web dry content of, e.g., 60%. Thereafter, the pulp web is guided through the remaining drier groups. The pulp web may be guided through drier groups 21, 22, 23, and 24 by, e.g., a top-felted single felt and a plurality of guide rolls 20, as shown in the FIGURE. Drier group 25 may include, e.g., a double felt drier group, as shown in the FIGURE. Further, drier group 25 may be followed by another double felt drier group, not shown.

As schematically shown in the FIGURE, twin wire shaper F, each aggregate within press section P and each aggregate within drier section T may have its own driver M for independently driving the aggregate. Each driver M may be connected through a line system with a speed governor (regulator) 30 and may also be coupled to a respective driven member for each aggregate. Further, speed governor 30 may be coupled to a tension monitoring device (not shown) that determines the tension of the web in each point of separation between adjacent aggregates. Thus, by monitoring a tension on the web at each separation space, the governor 30 may individually drive a driven member of each aggregate to maintain and/or correct the web tension. For example, in twin wire former F, the driven member may be roll F', in press section P, the driven members may be press cylinder 11 and press cylinder 12, in drier section T, the driven members may be drier cylinder 21*a*, drier cylinder 22*c*, drier cylinder 24'", and drier cylinder 25*b*. In each of the top felted drier groups, the last drier cylinder is preferred as the driven member. Thus, because the last cylinder of drier group 23 is not shown, a driver M designated for driving drier group 23 has not been shown in the FIGURE. However, it is noted that such a driver may be utilized in accordance with the present invention. It is also noted that any member of each respective aggregate capable of guiding the pulp web to the next adjacent aggregate may be utilized as the driven member, e.g., cylinders, guide rolls, etc.

Speed governor 30 may regulate, in a known manner, any desired speed difference between each adjacent aggregate to maintain tension on the web within the separation space. That is, to ensure that the pulp web is properly stretched, the driver for a downstream aggregate should drive its respective drive cylinder at a speed slightly greater than the speed of the adjacent upstream aggregate. However, as the pulp web dries, web shrinkage may occur. Thus, at the end of the drier section speed governor 30 may drive the last drier group at a speed lower than its adjacent upstream aggregate so as to maintain web tension during shrinkage of the drying web. However, in accordance with the present invention, the regulated speed differences between each adjacent aggregate may be set to a relatively small value so that the still moist web is carefully stretched at each point of separation by only a small amount. Because the wet pulp web is only stretched a small amount, web breaks may be substantially reduced with respect to the prior art.

As noted above, the drivers for driving the last press before drier section T, e.g., press cylinder 12, and for driving the drier groups of the initial portion of drier section T, e.g., drier cylinders 21, 22, and 23, may be set so that a slight speed difference occurs between each adjacent aggregate, the slight speed increasing as the pulp web moves downstream. This slight speed difference ensures that the still wet web may be slightly stretched in the running direction at each point of separation, i.e., moving from one aggregate to the next. Thus, slight stretching (i.e., maintaining tension) of the pulp web occurs in a plurality of locations along the paper machine, thus, resulting in a stretching of the web in smaller increments along the length of the web than in the prior art. Because of the smaller increments, the still moist web may be guided essentially without an open draw across each of the points of separation.

In the arrangement of the aggregates of the paper machine, the present invention not only guides the pulp web across the points of separation within the drier section, but guides the web across the points of separation between, e.g., the last press before the drier section and the first drier group and between the point of separation between the presses within the press section, if applicable. Thereby, the still wet web may be guided more gently through the paper machine, which considerably reduces the danger of web breaks.

By considering the above-noted factors, the short drier groups in the initial portion of drier section T may be appropriately arranged to optimize the treatment of the pulp web. The pulp web may include an initial wet strength (INF) that depends upon, e.g., ash content (or filler share). As the ash content increases, the wet strength decreases, thereby rendering handling of the pulp web more difficult for the paper machine. The arrangement of the drier groups may also depend upon the dry content of the paper upon entry into drier section T. The dry content of the pulp web may be proportional to web tension or stretching. Thus, when the INF value of the pulp web is low, a greater number of short drier groups may be arranged within the initial portion of drier section T than when a higher INF value is utilized. Conversely, as INF values increase, the number of drier groups may decrease to as little as, e.g., only one short drier group within the initial portion of drier section T. Further, when considering the dry content at the entry to the drier section, and when the dry content is low, the optimum arrangement is to utilize a large number of drier groups in which each drier group is small, i.e., each drier group includes a small number of drier cylinders. In a situation in which both the INF and the dry content are low, the optimum arrangement for treating the pulp web may be to utilize, e.g., three drier groups within the initial portion of drier section T including two to three drier cylinders per drier group.

Accordingly, the number of drivable aggregates necessary to obtain a desired median web dry content, e.g., 60%, at the end of the initial portion of the drier section T, may be dependent upon the INF. In general, for example, depending upon the dry content of the pulp web, for an initial wet strength (INF) of less than approximately 60–65 kN/m, three short drier groups may advantageously be arranged as the initial portion of drier section T; for an INF of less than approximately 75–85 kN/m, two short drier groups may be advantageously arranged as the initial portion of drier section T. Thus, in accordance with the above discussion, for lower INF values, a greater number of aggregates may be utilized within the web production machine, and as INF values increase, a decreasing number of aggregates may be utilized within the web production machine. Further, the low number of aggregates may include, e.g., only one short drier group if the INF values warrant such an arrangement.

Because each of the aggregates of the paper machine are independently driven, stretching of the pulp web may greatly increase with constant machine speed and with increasing ash content (i.e., decreasing INF). Further, the stretching of the pulp web may be proportional to the constant dry content of the web. Further, a ratio between the machine speed and web tension may be determined. In an alternative embodiment, a single driver may be utilized to drive both press cylinders in press section P. In a further alternative, each driver of press section P may receive a same signal from speed gevernor 30 (indicated by the dashed line) to regulate press cylinder 11 and press cylinder 12 at a same speed.

Accordingly, given the respective speed difference between each adjacent aggregate, determination of a separation between each adjacent aggregate should consider the above-noted factors to optimize the stretching of the pulp web. This may be especially necessary as machine speed increases.

What is claimed:

1. A process for the production of a pulp web in a paper production machine comprising:

forming the pulp web from a pulp suspension;

guiding a moist pulp web through a plurality of individual aggregates in a running direction, the individual aggregates including at least one press section and a plurality of drier groups;

independently driving each aggregate;

maintaining tension on the moist pulp web at each transition between adjacent aggregates;

selecting a specified number of aggregates based upon an initial wet strength of the moist pulp web and passing said web through said selected number of aggregates.

2. A process according to claim 1, guiding the moist pulp web from an upstream aggregate to an adjacent downstream aggregate substantially without an open draw.

3. A process according to claim 1, guiding the moist pulp web into an initial portion of a drier section, the initial portion including a plurality of drier cylinders;

contacting the drier cylinders in the initial portion with a lower side of the moist web.

* * * * *